US008278260B2

(12) United States Patent
Saint Victor

(10) Patent No.: US 8,278,260 B2
(45) Date of Patent: Oct. 2, 2012

(54) WATER-ACTIVATED "GREEN" CLEANING WIPE

(75) Inventor: Marie-Esther Saint Victor, Glencoe, IL (US)

(73) Assignee: S.C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 12/545,126

(22) Filed: Aug. 21, 2009

(65) Prior Publication Data

US 2010/0144584 A1 Jun. 10, 2010

(51) Int. Cl.
*C11D 17/04* (2006.01)
*C11D 3/22* (2006.01)

(52) U.S. Cl. ..... 510/438; 510/108; 510/180; 510/181; 510/238; 510/439; 510/470; 510/495

(58) Field of Classification Search ..... 510/438, 510/439, 470, 495, 108, 180, 181, 238
See application file for complete search history.

(56) References Cited

U.S. PATENT DOCUMENTS

| | | | | |
|---|---|---|---|---|
| 6,114,298 | A * | 9/2000 | Petri et al. | 510/372 |
| 6,322,801 | B1 * | 11/2001 | Lorenzi et al. | 424/402 |
| 6,495,151 | B2 | 12/2002 | McAtee et al. | |
| 6,586,385 | B1 | 7/2003 | Wisniewski et al. | |
| 6,613,731 | B1 * | 9/2003 | Murch et al. | 510/430 |
| 6,663,306 | B2 | 12/2003 | Policicchio et al. | |
| 6,669,391 | B2 | 12/2003 | Policicchio et al. | |
| 6,677,294 | B2 * | 1/2004 | Shaw et al. | 510/438 |
| 6,713,414 | B1 | 3/2004 | Pomplun et al. | |
| 6,814,519 | B2 | 11/2004 | Policicchio et al. | |
| 6,821,940 | B2 * | 11/2004 | Bullock et al. | 510/439 |
| 6,854,911 | B2 | 2/2005 | Policicchio et al. | |
| 6,910,823 | B2 | 6/2005 | Policicchio et al. | |
| 6,948,873 | B2 | 9/2005 | Policicchio et al. | |
| 6,955,817 | B2 | 10/2005 | McAtee et al. | |
| 6,992,054 | B2 | 1/2006 | Lee et al. | |
| 7,132,377 | B2 | 11/2006 | Borgonjon et al. | |
| 7,144,173 | B2 | 12/2006 | Policicchio et al. | |
| 7,163,349 | B2 | 1/2007 | Policicchio et al. | |
| 7,182,537 | B2 | 2/2007 | Policicchio et al. | |
| 7,250,174 | B2 | 7/2007 | Lee et al. | |
| 7,465,700 | B1 * | 12/2008 | Ochomogo et al. | 510/474 |
| 7,608,573 | B1 | 10/2009 | Scheuing et al. | |
| 7,618,931 | B1 | 11/2009 | Scheuing et al. | |
| 2002/0031486 | A1 | 3/2002 | Lunsmann et al. | |
| 2002/0168216 | A1 | 11/2002 | Policicchio et al. | |
| 2003/0069148 | A1 | 4/2003 | Booker et al. | |
| 2003/0119705 | A1 | 6/2003 | Barnabas et al. | |
| 2003/0126710 | A1 | 7/2003 | Policicchio et al. | |
| 2003/0143263 | A1 | 7/2003 | Durden et al. | |
| 2005/0026802 | A1 | 2/2005 | Kilkenny et al. | |
| 2005/0124519 | A1 | 6/2005 | Sherry et al. | |
| 2005/0136531 | A1 | 6/2005 | Sosalla et al. | |
| 2005/0158369 | A1 | 7/2005 | Dorschner et al. | |
| 2005/0164901 | A1 | 7/2005 | Foley et al. | |
| 2005/0208111 | A1 | 9/2005 | Kelly | |
| 2006/0039956 | A1 | 2/2006 | Hensen et al. | |
| 2006/0094625 | A1 * | 5/2006 | Horton, III | 510/407 |
| 2006/0094629 | A1 * | 5/2006 | Horton, III | 510/421 |
| 2006/0094632 | A1 * | 5/2006 | Horton, III | 510/438 |
| 2006/0128591 | A1 * | 6/2006 | Albrecht et al. | 510/438 |
| 2006/0246120 | A1 | 11/2006 | Kelly et al. | |
| 2008/0255023 | A1 | 10/2008 | Shimmin et al. | |
| 2008/0318822 | A1 * | 12/2008 | Ochomogo et al. | 510/106 |
| 2009/0016974 | A1 | 1/2009 | Pruche et al. | |
| 2009/0023620 | A1 * | 1/2009 | Ochomogo et al. | 510/106 |
| 2009/0104430 | A1 | 4/2009 | Cordial et al. | |
| 2009/0165228 | A1 * | 7/2009 | Kilkenny et al. | 15/104.94 |
| 2009/0188055 | A1 * | 7/2009 | Bernhardt et al. | 8/137 |
| 2009/0191248 | A1 * | 7/2009 | Hoffman et al. | 424/402 |
| 2010/0016198 | A1 * | 1/2010 | Bernhardt et al. | 510/127 |
| 2010/0184633 | A1 * | 7/2010 | Bernhardt et al. | 510/384 |
| 2010/0234271 | A1 * | 9/2010 | Scheuing et al. | 510/465 |

FOREIGN PATENT DOCUMENTS

| | | | |
|---|---|---|---|
| EP | 0950705 | A1 | 10/1999 |
| EP | 1063284 | A1 | 12/2000 |
| EP | 1097987 | A1 | 5/2001 |
| EP | 1167510 | A1 | 1/2002 |
| JP | 05156300 | A * | 6/1993 |
| WO | 0177281 | A1 | 10/2001 |
| WO | 03037292 | A1 | 5/2003 |
| WO | 03037293 | A1 | 5/2003 |
| WO | WO 2008/058693 | | 5/2008 |

OTHER PUBLICATIONS

PCT/US2010/002276 International Search Report dated Nov. 23, 2010.

* cited by examiner

*Primary Examiner* — Lorna M Douyon

(57) ABSTRACT

Eco-friendly, or "green", cleaning wipes are disclosed. The wipes may include a substrate and a green concentrated aqueous cleaning composition impregnated therein. The wipes are dry to the touch before they are activated by water and applied to inanimate surfaces for cleaning. Because of the green concentrated cleaning composition and water-activation just before application, the disclosed wipes may clean larger surface areas and have longer shelf lives and lower weights for easy transportation, packaging and handling than conventional wet wipes that are pre-loaded with a diluted cleaning composition.

12 Claims, No Drawings

WATER-ACTIVATED "GREEN" CLEANING WIPE

BACKGROUND

1. Technical Field

Eco-friendly, or "green," cleaning wipes are disclosed. The wipe may include a substrate and a green concentrated aqueous cleaning composition impregnated therein. The wipe may be dry to the touch before they are activated by water and applied to inanimate surfaces for cleaning. Because of the green concentrated cleaning composition and water-activation just before application, the disclosed wipes may clean larger surface areas and have longer shelf lives and lower weights for easy transportation, packaging and handling than conventional "wet" wipes that are pre-loaded with a diluted cleaning composition.

2. Description of the Related Art

Disposable cleaning wipes and pads are known in the art. The wipe generally incorporates a substrate and a cleaning composition into a single article to improve cleaning efficiency and convenience over conventional cleaning products in which the cleaning substrate and cleaning compositions are independently selected and applied to the surface to be cleaned. Thus, cleaning wipes have been widely used in car care, skin care, household cleaning, etc. Besides cleaning, the wipes may also deliver an active, such as a disinfectant or fragrance, to a target surface.

Known disposable cleaning wipes for cleaning hard-surfaces are typically wet and pre-loaded, i.e. impregnated with the cleaning composition without subsequent dilution before the wipes are applied to the target surface. Typically, those compositions include a substantial amount of water. For example, some cleaning compositions impregnated into conventional wipes may include more than 50%, 60%, 70%, 80% or even more than 90% water. As a result of such high water contents, conventional wipes, especially those with substrates including natural or green fibers, tend to have a short shelf life due to the integrity of the fibers being weakened by the prolonged exposure to water.

Another effect of high water contents in conventional wipes is the increased weight, which may adversely affect transportation, handling, packaging and storage of the wipes. For example, some conventional wipes are preloaded with 6-7 grams of aqueous cleaning composition. More importantly, as the relatively dilute cleaning composition depletes, the effectiveness of conventional wipes may decrease rapidly. Therefore, only limited surface areas can be cleaned by a single wipe. For example, a single conventional wipe typically cannot clean an entire bathtub. Thus, regular household cleaning tasks, such as bathtub cleaning, would generally require quite a few conventional wipes, which not only increases the consumption of raw material used to manufacture the wipes but also requires more effort and energy to dispose and recycle the used wipes.

Finally, the high water content in conventional wipes generally necessitate the inclusion of preservatives, which not only increase the manufacturing cost of the wipe but also adversely affect the ecological profile of the wipes because the preservatives are generally synthetic and not derived from natural and renewable sources.

In recent years, there has been a significant amount of global consumer awareness in green, i.e., eco-friendly, household or personal care products. As a result, increasing efforts have been directed to the development of household products with desirable ecological profiles. For example, products containing ingredients that are derived from natural and renewable sources, as well as products that are biodegradable in natural environments, have been a focus of this global "eco-friendly" trend.

Indeed, products derived from renewable resources, such as plants, contribute less greenhouse gas because of their closed $CO_2$ cycle. Specifically, during growth, plants consume the same amount of carbon dioxide ($CO_2$) and water ($H_2O$) as they subsequently release into the atmosphere by biodegradation after use. Therefore, products derived from renewable resources, such as plants, are considered to be "green" and having zero or reduced "carbon footprint" when compared with petrochemical-based products. Common ingredients in household products such as surfactants, fragrances, oils and solvents can be derived directly or indirectly from both renewable sources such as plant materials or non-renewable sources such as petroleum.

In particular, while most surfactants are still derived from petroleum chemicals, surfactants derived from plant-based carbohydrates and oils are becoming available. One suitable renewable raw material for surfactant production is glucose, which is reacted with alcohol to produce alkyl polyglycosides (also known as alkyl polyglucosides). Alkyl polyglycosides have been used in cosmetics products, agricultural formulations and as surfactants in industrial cleaning agents. Alkyl polyglycosides include a hydrophobic (or lipophilic) hydrocarbon chain is formed by a fatty alcohol (e.g., dodecanol, tetradecanol) obtained from a saturated tropical oils such as palm or coconut oil. The hydrophilic part of the molecule, derived from glucose or dextrose, maybe obtained from starch, brown algae, citrus or beet pulp, most commonly from corn.

In addition to its desirable ecological profile, alkyl polyglycosides have good compatibility with the eyes, skin and mucous membranes and even reduce the irritant effects of surfactant combinations. Alkyl polyglycosides are also completely biodegradable, both aerobically and anaerobically.

Some anionic surfactants may also have immediate precursors that are obtainable from natural and renewable sources. For example, long-chain alkyl sulfates may be conveniently prepared from fatty alcohols derived from coconut oils. In particular, sodium coco sulfate (SCS) is derived from pure coconut oil and includes a mixture of sodium alkyl sulfate with the main component being sodium lauryl sulfate. Sodium coco sulfate may be used in a wide variety of consumer products in which viscosity building and foam characteristics are of importance. It can be incorporated into shampoos, hand soaps, bath products, shaving creams and medicated ointments.

Compositions for controlled release of active substances are also known in the art. For example, fragrance or insecticide compositions in the form of single-phase solution have been developed to allow prolonged release of a fragrance or insecticide into the air. However, those compositions generally have a less desirable ecological profile in order to maintain their fragrance or insecticide delivery performance.

Thus, there is a need for a cleaning wipe with more desirable ecological profile and longer shelf live to clean larger surface areas than conventional wipes. Moreover, there is a need for a cleaning wipes with lower water content for easier transportation, packaging, handling, and storage than conventional "wet" wipes that are pre-loaded with a diluted cleaning composition. Finally, there is a need for an eco-friendly wipe impregnated with a cleaning composition with all ingredients derived from natural and renewable sources or having a higher percentage of ingredients that are derived from natural and renewable sources.

SUMMARY OF THE DISCLOSURE

In satisfaction of the aforementioned needs, cleaning wipes with desirable ecological profiles and improved performances are disclosed. The wipes may include a substrate and a concentrated cleaning composition impregnated therein. Unlike "wet" wipes preloaded with a dilute cleaning liquid, the disclosed wipes may be dry to the touch and activated by water just prior to its application on a target surface.

As used in this disclosure, a green component or ingredient is defined as a substance that is obtainable from natural and renewable sources or is prepared from immediate precursor(s) obtainable from natural and renewable sources. The term "Natural Index" (NI) is used herein to refer to the weight percentage of the composition that includes ingredients that are either directly obtainable from natural and renewable sources or made from immediate precursors that are directly obtainable from natural and renewable sources.

In one embodiment, the substrate of the disclosed wipe may include green components such as natural fibers, naturally derived fibers, or a blend thereof. In a refinement, the substrate may be made entirely of green components. In another embodiment, the substrate may include synthetic fibers that are not derived from natural and renewable sources. The substrate of the disclosed wipe may be woven or nonwoven.

The disclosed wipe also includes a cleaning composition impregnated into the substrate. In one embodiment, the cleaning composition is evenly distributed throughout the substrate for consistent cleaning performance. Because the wipe is dry to the touch, the substrate of the disclosed wipe may not require non-impregnated side margins for packaging, handling, and/or transportation purposes.

The cleaning composition may have an improved ecological profile without sacrificing the cleaning performance thereof. In one embodiment, the cleaning composition is a concentrated aqueous composition with water content of less than 50 wt %. The cleaning composition may be present as a regular emulsion, a micro-emulsion, or even a solution.

The cleaning composition may include one or more "green" surfactants as cleaning agents. Moreover, the composition may further include other optional green ingredients such as green hydrotropes, green pH adjusting agents, natural fragrance, etc. The water content of the composition may be 10-40 wt % and more preferably 10-30 wt %.

In one embodiment, the cleaning composition is a cleaning composition that includes a green nonionic surfactant and water. In a refinement, the green nonionic surfactant may include an alkyl polyglycoside.

In a further refinement, the cleaning composition may also include one or more green co-surfactants. The green co-surfactants may include an anionic surfactant such as sodium lauryl sulfate or sodium coco sulfate. The combination of green surfactants may synergistically improve cleaning performance of the composition.

In another embodiment, the cleaning composition is a cleaning composition that includes one or more green surfactants, a green hydrotrope, and water. In a refinement, the one or more green surfactants may be nonionic, anionic, or a mixture of both. In another refinement, the green hydrotrope may be a glucoside such as coco glucoside or hexyl glucoside. The combination of the green surfactant(s) and the green hydrotrope may synergistically improve the cleaning performance of the composition. Moreover, when used as a glass cleaner, the cleaning composition may have less streaking than conventional glass cleaning products.

In a further embodiment, the cleaning composition is an active delivery composition that includes one or more green surfactants, one or more natural actives, and water. In a refinement, the one or more green surfactants may be nonionic, anionic, or a mixture of both. In another refinement, the one or more natural actives may be selected from the group consisting of natural fragrances, natural insecticides, natural oils, and mixtures thereof. The combination of the green surfactant(s) and the natural active(s) allows for an improved release of the actives without sacrificing the ecological profile of the composition.

In some embodiments, the green surfactant(s) and other green ingredients of the cleaning composition may not only improve the ecological profile of the compositions but also allow spontaneous solubilization of soils at room temperature. It is contemplated that the presence of the cleaning composition as micro-emulsions may contribute to the enhanced performance of the composition.

The disclosed wipe is activated by water just prior to its application on a target surface. For example, a user may simply contact the disclose wipe with tap water to dilute the concentrated cleaning impregnated therein. The activated wipe is then applied to the target surface for cleaning and other beneficial purposes. In this embodiment, the use of tap water to activate the wipe just prior to use not only significantly reduces the weight of the wipe for more convenient packaging, storage, and transportation, but also reduces the consumption of distilled water used during the manufacturing of the conventional wet wipes.

The disclosed wipe may be suitable for a wide variety of cleaning tasks. For example, the wipe may be used as a glass-cleaning wipe, a bathroom-cleaning wipe, floor cleaning wipe or even an all-purpose wipe. In one embodiment, the wipe not only effectively removes soils from a target surface but also leave no visible residue on the target surface. In another embodiment, the wipe may reduce streak when used as a glass cleaner.

Other advantages and features of the disclosed wipe and the method of use thereof to clean a target surface will be described in greater detail below. It will also be noted here and elsewhere that the disclosed wipe may be suitably modified to be used in a wide variety of household and other applications by one of ordinary skill in the art without undue experimentation.

DETAILED DESCRIPTION OF THE PRESENTLY PREFERRED EMBODIMENTS

This disclosure is generally related to an eco-friendly cleaning wipe that includes a concentrated green cleaning composition. To evaluate the ecological profile a cleaning wipe or composition, the term Natural Index (NI) is used herein to refer to the weight percentage of the composition that includes ingredients that are either directly obtainable from natural and renewable sources or made from immediate precursors that are directly obtainable from natural and renewable sources.

For example, ingredients such as water, ethanol, lactic acid, citric acid, caustic soda, natural fragrances, natural fibers such as wood pulp and cotton, are all obtainable from natural and renewable sources. Moreover, compounds like alkyl polyglycosides, alkyl glucoside, sodium coco sulfate (sodium lauryl sulfate) used in the cleaning composition of the disclosed wipe may be made from immediate precursors (fatty alcohols, glucose, etc.) that are obtainable from natural and renewable sources. Similarly, naturally derived fibers used in the substrate of the disclosed wipe, such as rayon, lyocell, and viscose, may also be made from immediate precursors (wood pulp, cotton, etc.) that are obtainable from natural and renewable sources.

On the other hand, surfactants such as ethoxylated nonionic surfactants, alkylbenzene sulfonate anionic surfactants, and quaternary ammonium cationic surfactant are at least partially based on petroleum chemicals and thus do not contribute toward the NI of the composition. Similarly, truly synthetic fibers, such as nylon, polyester, acrylic, carbon fibers, glass fibers, metal fiber, etc., are also based on immediate precursors that are not obtainable from natural and renewable sources.

In a general embodiment, the disclosed wipe includes a substrate and a green cleaning composition impregnated therein. In one embodiment, the disclosed wipe is loaded with from about 0.1 to about 0.2 gram of the cleaning composition. The green cleaning composition is aqueous-based and may include a green nonionic surfactant that is made from immediate precursors that are obtainable from natural and renewable sources. The water content of the composition may be 10-40 wt % or more preferably 10-30 wt %. The composition may also include one or more secondary green ingredients, such as fragrances, hydrotropes, co-surfactants, pH adjusting agents, etc. The composition may be essentially free of organic solvents. Moreover, the composition may be VOC-free.

Substrate

The cleaning composition described above is impregnated into a substrate and activated by water just prior to application on a target surface. To that end, one function of the substrate is that it provides a matrix in which the concentrate cleaning composition can be not only retained during storage, handling and transportation but also diluted when the wipe is in contact with water just prior to use. Thereafter, the substrate may also functions as an applicator to deliver and distribute the diluted cleaning composition to the target surface. The composition may be diluted multiple times before it is depleted from the substrate. Optionally, the substrate may also function to scrub the surface and to absorb at least some soil that is dislodged from the surface. Finally, the substrate may be used as a vehicle to deliver other green active ingredients such as, but not necessarily limited to, fragrances, insect repellant, insecticides, oils, etc.

The substrate of the disclosed wipe may include green fibers such as natural fibers, naturally derived fibers, or a blend thereof. The natural fibers may be cellulose-containing fibers including, but not limited to, cotton fiber, flax fiber, hemp fiber, sisal fiber, jute fiber, kenaf fiber, bamboo fiber, coconut fiber, and wood pulp. Naturally derived fiber suitable for use in this disclosure may include, but are not limited to, rayon, lyocell, and viscose or other materials derived from natural fibers. For example, lyocell may be derived from wood pulp, viscose may be derived from wood or cotton fibers, and rayon may be derived from a wide variety of cellulose-containing natural fibers.

In some non-limiting embodiments, the substrate may be made from a blend of natural and naturally derived fibers. In one embodiment, the substrate includes a blend of cotton and viscose fibers. In another embodiment, the substrate includes a blend of wood pulp and viscose fiber. The substrate may include green fibers as a major component or may be made entirely of green fibers.

In some embodiment, the substrate may also include one or more synthetic fibers not derived from natural and renewable sources. Synthetic fibers suitable for use in the substrate of the disclosed wipe may include, but are not limited to, nylons, polyesters, acrylics, olefin fibers such as polyethylene and polypropylene, carbon fibers, glass fibers, metal fibers, ect. In one embodiment, the substrate may include a blend of polyester, viscose, and lyocell (Tencel®).

In some embodiments, the substrate may include synthetic fibers as a minor component of the substrate. In other embodiments, however, the substrate may include synthetic fibers as a major component or may even be made entirely of synthetic fibers. The substrate may be woven or nonwoven.

Other factors that may affect the selection of a suitable substrate component include such considerations as integrity, hand feel, processability and cost. In general, the substrate should not excessively tear or fall apart during the application of the wipe on the target surface or the subsequent optional rewetting and reapplication processes.

The substrate may take one of a wide variety of physical forms. In one embodiment, the substrate is a woven or nonwoven sheet with suitable dimension for household cleaning tasks. Other forms for the substrate may include, but are not limited to fiber balls, beads or other forms of intercalation support structures. In one embodiment, the substrate has a uniform structure and free of any laminated configuration to facilitate even distribution or impregnation of the cleaning composition throughout the substrate. It is to be understood that the shape and dimension of the substrate would be apparent to those skilled in the art and should not be considered as limiting the scope of this disclosure.

Green Surfactants

In a general embodiment, the cleaning composition of the disclosed wipe may include one or more green surfactants and water. In one embodiment, the cleaning composition may include from 15 to 80 wt %, more preferably from 15 to 75 wt % green surfactants. In another embodiment, the green surfactants may be included at a level of from 18 to 60 wt %.

The green nonionic surfactants of the cleaning composition may include, but are not limited to, sugar-based surfactants, polyol-based surfactants, alkyl ethers, and alkyl carbonates. The sugar-based surfactants may be alkyl polyglycoside (or alkyl polyglucoside) surfactants that are made from fatty alcohols in coconut oil and polyglucose in corn. In addition to its excellent ecological profile, alkyl polyglycosides are biodegradable, non-irritating to human skin, and effective in solubilizing fragrance oil in water.

The alkyl polyglycosides which can be used in the disclosed emotions correspond to the following formula I:

$$R_1O(R_2O)_b(Z)_a$$

wherein $R_1$ is a monovalent organic radical having from about 4 to about 22 carbon atoms; $R_2$ is a divalent alkylene radical having from 2 to 4 carbon atoms; Z is a saccharide residue having 5 or 6 carbon atoms; b is a number having a value from 0 to about 12; a is a number having a value from 1 to about 6. For example, alkyl polyglycosides of formula I wherein Z is a glucose residue and b is zero may be utilized. Such alkyl polyglycosides are commercially available, for example, as APG®, GLUCOPON® or PLANTAREN® surfactants from Cognis, 5051 Estecreek Drive, Cincinnati, Ohio 45232.

Suitable alkyl ethers used as green surfactants in the cleaning composition may include ethers with $C_4$-$C_{22}$ alkyl chains on either side of the C—O—C bond ($R_1$—O—$R_2$). The alkyl chains ($R_1$, $R_2$) may be saturated or unsaturated. In one embodiment, the alkyl ether may be dicaprylyl ether.

Suitable alkyl carbonates used as green surfactants in the cleaning composition may include carbonates with $C_4$-$C_{22}$ alkyl chains on either side of the carbonate group

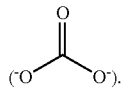

The alkyl chains may be saturated or unsaturated. In one embodiment, the alkyl ester may be dicaprylyl carbonate.

Other nonionic green surfactants suitable for use in the cleaning composition may include, but are not limited to, alkyl glucose amide, triglycerides, N-methyl cocnut fatty acid glucamides (C12-14), amino acid-based surfactants, sugar esters, sorbital esters, sterol esters, glycolipid biosurfactants, etc.

In one embodiment, the cleaning composition may include from 5 to 80 wt %, more preferably from 5 to 75 wt % green nonionic surfactant(s). In another embodiment, the green nonionic surfactant(s) may be included at a level of from 8 to 65 wt %.

In addition to the green nonionic surfactant, the cleaning composition may optionally include one or more green co-surfactants. The green co-surfactants may be anionic, cationic, zwitterionic, or amphoteric surfactants prepared from immediate precursors that are obtainable from natural and renewable sources.

In one embodiment, the green anionic surfactants include one or more long-chain alkyl sulfates. Suitable alkyl sulfates includes, but are not limited to, sodium $C_8$-$C_{20}$ sulfates, ammonium $C_8$-$C_{20}$ sulfates, and mixtures thereof. In addition, the green anionic surfactant may also include surfactants based on alginates (cell-wall polyuronic acids from brown seaweeds) or ulvans (sulfated rhamnouronans from the cell wall of green seaweeds).

In a preferred embodiment, the green anionic surfactant includes sodium coco sulfate or sodium lauryl sulfate. Sodium coco sulfate may be prepared from sulfating coconut oil, which is made up of a wide range of fatty acids (ranging from as few as 8 carbon alkyl chains to as many as 20. The majority, e.g. 45-50%, of the fatty acids in coconut oil are fatty acids containing 12 carbons. Sodium lauryl sulfate, on the other hand, is a purified version of the sodium coco sulfate. During manufacturing of sodium lauryl sulfate, coconut oil is processed to remove most of the non-12 carbon fatty acids before the fatty acids are sulfated.

The green anionic surfactant may be used in the cleaning composition to synergistically improve the performance, such as soil removal, of the composition. Accordingly, a relatively low level of the green anionic surfactant is required. For example, the concentration of the green anionic surfactant(s) may be from 5 to 40 wt %, from 5 to 30 wt % or even from 5 to 25 wt %. In some embodiment, the total surfactant level of the cleaning composition may be no less than 50 wt %, 60 wt %, 70 wt %, or even 80 wt % so that the wipe may clean a larger surface area than conventional wet wipes loaded with a diluted cleaning composition.

In addition, the green co-surfactant may be a cationic surfactant, particularly, ester-type and amide-type glycine based surfactants derived from a renewable raw material such as glycine betaine (from sugar beet) and European and/or tropical oils. Bipolar amphiphiles (bolaamphiphiles) combining a sugar polar head at one end and a cationic polar head at the other end may also be used.

Green Hydrotropes

The cleaning composition may optionally include one or more green hydrotropes. Suitable green hydrotropes may include alkyl glucosides and other hydrotropes prepared from immediate precursor(s) that are obtainable from natural and renewable sources. The alkyl glucoside used in the cleaning composition may be coco glucoside, hexyl glucoside, or a mixture of both.

In particular, hexyl glucoside used in the cleaning composition is commercially available (as "AG 6206") from Akzo Nobel, 525 W. Van Buren Street, Chicago, Ill. 60607-3823. The hydrophilic part of the hexyl glucoside, derived from glucose or dextrose, may be obtained from starch, most commonly from corn. Similarly, coco glucoside used in the cleaning composition is very mild to the skin and derived from coconut oil and fruit sugar.

The green hydrotropes may be used in the cleaning composition to synergistically improve the performance, such as soil removal and/or streak reduction, of the composition. As a result, relatively low levels of the green linkers are required. In one embodiment, the cleaning composition may include from 0.001 to no more than 2 wt % green hydrotropes. In another embodiment, the green linker(s) may be included at a level of from 0.001 to 1 wt %, 0.001 to 0.5 wt % or 0.001 to 0.1 wt %. In some embodiments in which one or more green hydrotropes are added to the composition to synergistically improve its performance, the concentration of the green hydrotrope(s) may be reduced to 0.001-0.05 wt % or even 0.001-0.01 wt %.

Without wishing to be bound by any particular theory, hydrotropes are added to the cleaning composition to enhance the solubilization of soils in the cleaning composition. Further, the efficiency of the solubilization may be dependent on the ratio of the green surfactants and the green hydrotropes, the total concentration of the surfactants and/or hydrotropes, or both. In some embodiments, effective solubilization of soils may require the presence of only a small amount of linkers, such as no more than 0.1 wt %, 0.05 wt %, or even 0.01 wt %.

Natural (Green) Fragrances

The cleaning composition may optionally include one or more fragrances derived in from natural and renewable sources such as plants or crops. In addition, the composition may deliver the natural fragrances into the air in a controlled manner over a long period of time. To that end, the presence of the composition as micro- or nano-emulsions may facilitate the consistent release of the fragrances.

For example, the cleaning composition may include a natural fragrance for air freshening. The natural fragrance freshens air either by masking one or more malodors therein or by imparting a pleasant smell to the air, or both. As is well known, a fragrance normally consists of a mixture of a number of fragrant materials, each of which has a particular fragrance. The number of fragrant materials in a fragrance is typically ten or more. The range of fragrant materials used may vary. The materials come from a variety of chemical classes, but in general are water-insoluble oils. In many instances, the molecular weight of a fragrance material is in excess of 150, but does not exceed 300.

The natural fragrance included in the cleaning composition may be present in an amount that is sufficient to impart a pleasant smell to the air that can be perceived by a consumer. In the presence of a malodor, the natural fragrance may be present in an amount that masks at least a substantial portion of the malodor in the air. More preferably, the natural fragrance included in the cleaning composition may be present in an amount that not only completely masks the malodors therein, but also delivers a pleasant smell to be perceived by a consumer.

The natural fragrance may be present in the cleaning composition in an amount of from 0 to 0.5 wt %, more preferably from 0 to 0.2 wt % and most preferably from 0 to 0.1 wt %. The amount of the fragrance that is needed to mask the malodor(s) therein, and/or the amount of the fragrance to impart the pleasant smell to be perceived by the consumer will be apparent to one of ordinary skill in the art.

The fragrance according to this disclosure may comprise one or more fragrant materials or materials that provide chemically active vapors. In one embodiment, the fragrance can comprise and/or include volatile, fragrant compounds including, but not limited to natural botanic extracts, essences, fragrance oils, and so forth. As is known in the art, many essential oils and other natural plant derivatives contain large percentages of highly volatile scents. In this regard, numerous essential oils, essences, and scented concentrates are commonly available from companies in the fragrance and food businesses.

Exemplary oils and extracts include, but are not limited to, those derived from the following plants: almond, amyris, anise, armoise, bergamot, cabreuva, calendula, canaga, cedar, chamomile, coconut, eucalyptus, fennel, jasmine, juniper, lavender, lemon, orange, palm, peppermint, quassia, rosemary, thyme, and so forth.

Fragrances can also be made of organic compounds derived from floral materials and fruits. Examples of suitable organic compounds include, but are not limited to, dimyrcetol, phenylethyl alcohol and tetrahydromuguol, decyl aldehyde, undecyl aldehyde, undecylenic aldehyde, lauric aldehyde, amyl cinnamic aldehyde, ethylmethyl phenyl glycidate, methyl nonyl acetaldehyde, myristic aldehyde, nonalactone, nonyl aldehyde, octyl aldehyde, undecalactone, hexyl cinnamic aldehyde, benzaldehyde, vanillin, heliotropine, camphor, parahydroxyphenolbutanone, 6-acetyl-1,1,3,4,4,6-hexamethyl tetrahydronaphthalene, alpha-methyl ionone, gamma-methyl ion-one, and amyl-cyclohexanone and mixtures thereof.

It is to be understood, of course, that the type, strength, and odor profile of the fragrance suitable for use in the disclosed aerosol composition would be apparent to one of ordinary skill in the art and therefore should not be considered as limiting the scope of this disclosure.

Green Antibacterial/Antimicrobial Agents

The cleaning composition may optionally include one or more antibacterial and/or antimicrobial agents derived in from natural and renewable sources. As a result, the disclosed wipe may deliver the antibacterial and/or antimicrobial agents onto the target surface for long lasting disinfecting/sanitization benefits.

The green antibacterial/antimicrobial agents suitable for use in the cleaning composition may include metals, metal salts, organic acids, and mixtures thereof. Suitable antimicrobial metals include, for example, Ag, Au, Pt, Pd, Ir, Cu, Sn, Sb, Pb, Bi, Zn and combinations thereof. Without wishing to be bound by any particular theory, the effectiveness of antimicrobial elemental metals is thought to be due to the formation of corresponding metal ions, such as through air oxidation. Likewise, salts of the antimicrobial metals may also be included in the cleaning composition. Upon dissolution, metal ions are released into the cleaning composition for providing antimicrobial benefits to the target surfaces. In one embodiment, the cleaning composition includes a mixture of colloidal silver and copper or zinc (in either elemental or salt form).

Organic acids suitable for used in the cleaning composition may be derived in from natural and renewable sources. For example, the cleaning composition may include organic acids such as acetic acid, benzoic acid, citric acid, lactic acid, malic acid, sorbic acid, tartaric acid, etc. In one embodiment, the cleaning composition includes a blend of colloidal silver and one or more organic acids to further enhance the antibacterial/antimicrobial performance of the cleaning composition.

The green antibacterial/antimicrobial agents may also include volatile essential oils obtained from plants. Suitable essential oils for use as antibacterial/antimicrobial agents may include, but are not limited to, citronella oil, lemon eucalyptus oil, cinnamon oil, castor oil, rosemary oil, lemongrass oil, cedar oil, peppermint oil, clove oil, geranium oil, verbena oil, pennyroyal oil, lavender oil, pine oil, cajeput oil, basil oil, thyme oil, allspice oil, soybean oil, garlic oil, Australian tea tree oil, etc. The essential oils may be used alone or combined with organic acids or antimicrobial metals discussed above.

The type, strength, and concentration of the natural antibacterial/antimicrobial agents suitable for use in the cleaning composition would be apparent to one of ordinary skill in the art and therefore should not be considered as limiting the scope of this disclosure.

Green pH Adjusting Agents

In some embodiments, the cleaning composition may optionally include one or more pH adjusting agents. Preferably, the pH adjusting agents used in the composition are derived from natural and renewable sources and thus do not negatively affect the ecological profile, i.e. Natural Index, of the composition.

Suitable pH adjusting agents may include bases such as sodium hydroxide (manufactured through electrolysis of salt solution), sodium carbonate (naturally occurring as mineral deposits), and sodium bicarbonate (naturally occurring in mineral natron). In addition, the green pH adjusting agents may include one or more organic acids derived from natural or renewable sources. For example, the organic acids may be citric acid (naturally occurring in fruits and vegetables), lactic acid (obtainable from fermentation of milk sugar, cornstarch, or potato), acetic acid (obtainable from fermentation of starch or fruit), etc. The use of lactic or citric acids may also have the benefit of soap scum and lime scale removal. Finally, the green pH adjusting agents may include one or more salts of the aforementioned organic acids, such as sodium citrate, sodium acetate, etc.

Of course, the type and concentration of the green pH adjusting agents suitable for use in the cleaning composition would be dependent on the desired pH of the composition and should be apparent to one of ordinary skill in the art without undue experimentation in light of this disclosure.

Green Streak Reduction Agent

In some embodiments, e.g. glass cleaning wipes, the cleaning composition may optionally include one or more streak reduction agents. Preferably, the streak reduction agents used in the composition are derived from natural and renewable sources and thus do not negatively affect the ecological profile, i.e. Natural Index, of the composition.

Suitable green streak reduction agents may include salts of a green organic acid, such as salts of tartaric acid, etc. In one embodiment, the cleaning composition includes 0-0.001 wt % tartaric acid salt.

Of course, the type and concentration of the green streak reduction agents suitable for use in the cleaning composition would be dependent on the specific application of the composition and should be apparent to one of ordinary skill in the art without undue experimentation in light of this disclosure.

One feature of the cleaning composition is its appropriate water content. High water content may decrease the amount of the cleaning agents, such as the surfactants, that can be delivered to the target surface by each cleaning wipe. As a result, wipes with relatively high water contents may clean substantially less surface areas than the disclose wipe. In one embodiment, the disclosed wipe effectively cleans 208.33% of a bathtub surface whereas a conventional wipe merely cleans 28% of same. In another embodiment, while a conventional wipe cleans 16.82% of a shower surface, the disclose wipe cleans 126.18% of same.

On the other hand, if the water content is too low and/or if a thickener is included, the cleaning composition may have a Theological characteristic that is less desirable for manufacturing and/or application of the cleaning wipe. For example, if the cleaning composition is in a form of a thick paste, it would be difficult to evenly impregnate the composition throughout the substrate. Moreover, such a thick paste may be less readily to be diluted into a consistent cleaning composition. In one embodiment, the disclosed wipe is essentially free of any thickeners.

The relatively low water content of the cleaning composition used in the disclosed wipe may also obviate the use of preservatives, which are otherwise necessary in cleaning compositions used in conventional wipes. Thus, in some embodiments, the disclosed wipe is essentially free of any preservatives. Further, the cleaning composition loaded on the disclose wipe is more concentrate, and thus may be loaded in smaller doses, than cleaning compositions used in conventional wet wipes. As a result, the disclose wipe weighs significantly less and is dry to the touch, which allows for more convenient and efficient storage, handling, and transportation. In one embodiment, the disclosed wipe includes from about 0.1 to about 0.2 gram of the concentrated cleaning composition.

Another feature of the cleaning composition used in the disclose wipe is its high Natural Index. As a result, the composition achieves improved performance without sacrificing the ecological profile thereof. For example, the composition may have a high Natural Index of no less than 85%, 95%, 97%, 98%, or even 98.5%. In one embodiment, the cleaning composition has a Natural Index of no less than 99%.

When the substrate of the disclose wipe is also made of green components such as natural or naturally derived fibers, the disclosed wipe may have a high Natural Index of no less than 85%, 95%, 97%, 98%, or even 98.5%. In one embodiment, the wipe has a Natural Index of no less than 99%.

Non-limiting exemplary cleaning compositions for used in the disclosed wipe are listed below.

| Function/ Description | Chemical Name/Trade Name | Concen- tration (wt %) | Natural Index (NI) (%) |
|---|---|---|---|
| | Composition A | | |
| Solvent | Water | 20 | 20 |
| Green nonionic surfactant | Alkyl polyglycoside/ Glucopon ® 425N | 60 | 60 |
| pH adjusting agent | Sodium citrate | 1 | 1 |
| pH adjusting agent | Sodium carbonate | 18.9 | 18.9 |
| Streak reduction agent | Tartaric acid salt | 0-0.001 | 0-0.001 |
| Fragrance | Fragrance | 0.1 | 0.1 |
| | | | 100 |

-continued

| Function/ Description | Chemical Name/Trade Name | Concen- tration (wt %) | Natural Index (NI) (%) |
|---|---|---|---|
| | Composition B | | |
| Solvent | Water | 10-40 | 10-40 |
| Green nonionic surfactant | Alkyl polyglycoside/ Glucopon ® 425N | 50-80 | 50-80 |
| pH adjusting agent | Sodium citrate | 0.4-0.5 | 0.4-0.5 |
| pH adjusting agent | Sodium carbonate | 9.5 | 9.5 |
| Fragrance | Fragrance | 0-0.1 | 0-0.1 |
| Streak reduction agent | Tartaric acid salt | 0-0.001 | 0-0.001 |
| | Composition C | | |
| Solvent | Water | 30 | 30 |
| Green surfactant | Alkyl polyglycoside/ Glucopon ® 425N | 20 | 20 |
| Green co-surfactant | Sodium coco sulfate | 20 | 20 |
| pH adjusting agent | Sodium citrate | 0.4 | 0.4 |
| pH adjusting agent | Sodium carbonate | 9.5 | 9.5 |
| Fragrance | Fragrance | 0.1 | 0.1 |
| | | | 100 |
| | Composition D | | |
| Solvent | Water | 20 | 20 |
| Green surfactant | Alkyl polyglycoside/ Glucopon ® 425N | 70 | 70 |
| Green hydrotrope | Hexyl glucoside or coco glucoside | 0.001-0.009 | 0.001-0.009 |
| pH adjusting agent | Sodium citrate | 0.4 | 0.4 |
| pH adjusting agent | Sodium carbonate | 9.5 | 9.5 |
| Fragrance | Fragrance | 0-0.1 | 0-0.1 |

Method of Use

In a general embodiment, this disclosure relates to a method for cleaning a target surface, particularly household surfaces such as bathroom and shower surfaces, comprising the steps of: providing a cleaning wipe in accordance with this disclosure; wetting the cleaning wipe with water to activate the wipe, i.e. to dilute the cleaning composition; and contacting the activated wipe with the target surface. Optionally, the method further includes the steps of rewetting the cleaning wipe and re-contacting the rewetted cleaning wipe with the target surface.

In one embodiment, the cleaning wipe is hand-applied onto the target surface. In another embodiment, the wipe is attached to the distal end of a cleaning device, such as a mop or sweeper. The wipe may be attached to the cleaning device prior to or after its activation. In a refinement, the cleaning device may include a water reservoir and a dispenser for spraying water directly onto the wipe when it is attached to the cleaning device.

As discussed above, the disclosed wipe is activated by water just prior to use. Water activation can be done by pouring water directly on the wipe or by quickly immersing the wipe into water. Alternatively, the target surface may be prewetted with water and the wipe may be activated by contacting the water on the target surface. The disclosed wipe may be activated one or more times during the cleaning process. For example, the wipe may be first water-activated then used for cleaning, then reactivated as needed to complete the cleaning task or until the cleaning composition of the wipe substantially depletes.

One feature of the disclosed wipe is that the cleaning composition is evenly impregnated throughout the substrate, thereby allows rapid and convenient water-activation. To that end, warm or hot water is not necessary to activate the disclosed wipe, which further reduces water and energy consumption. Moreover, because water-activation occurs just prior to the cleaning process, tap water or even recycled water would be sufficient to activate the wipe. However, the disclosed wipe is certainly capable of being activated by hot or warm water, or by water of higher purities than tap or recycled water.

Typically, water activation is achieved by exposing the cleaning wipe directly to a water source readily available in the bathtub or shower enclosure area, such as a bathtub faucet or shower head. Water can also be sourced from other locations and transferred to the wipe or surface to be cleaned by means of, for example, syringes, garden hoses, spray bottles, containers, buckets, and the like.

The disclosed method is particularly adapted for remove soils, soap scum, lime scale, and other dirty substances from household surfaces. However, the method may also provide additionally antibacterial and antifungal benefits to the target surfaces. It is to be understood that one of ordinary skill in the art would appreciate that despite the particular efficacy of the disclosed method and wipes for cleaning household surfaces, the same method and wipes can also be used to clean any other kind of inanimate surfaces, in particular hard surfaces.

While only certain embodiments have been set forth, alternatives and modifications will be apparent from the above description to those skilled in the art. These and other alternatives are considered equivalents and within the spirit and scope of this disclosure and the appended claims.

What is claimed is:

1. A cleaning wipe consisting of:

a substrate; and a cleaning composition impregnated into the substrate, the cleaning composition consisting of a green nonionic surfactant, a green hydrotrope, a green pH adjusting agent, from 0 to 0.001 wt % streak reduction agent, natural fragrances, water, and optionally: a green anionic surfactant and one or more green antimicrobial agents, wherein the green nonionic surfactant is an alkylpolyglycoside, the green hydrotrope is an alkyl glucoside, and the total green surfactant is present from at least 40 wt % and up to 80 wt %, the cleaning composition having a Natural Index of at least 95%.

2. The wipe of claim 1, wherein the substrate is a green fiber selected from the group consisting of natural fibers, naturally derived fibers, and blends thereof.

3. The wipe of claim 2, wherein the substrate is made entirely of green fibers.

4. The wipe of claim 1, wherein the cleaning composition is evenly distributed throughout the substrate.

5. The wipe of claim 1, wherein the green anionic surfactant is present in the cleaning composition.

6. The wipe of claim 5, wherein the green anionic surfactant is an alkyl sulfate.

7. The wipe of claim 6, wherein the alkyl sulfate is sodium lauryl sulfate or sodium coco sulfate.

8. The wipe of 1, wherein the alkyl glucoside is selected from the group consisting of coco glucoside, hexyl glucoside, and a mixture thereof.

9. The wipe of claim 1, wherein the green antimicrobial agents are selected from the group consisting of antimicrobial metals, antimicrobial metal salts, essential oils, and mixtures thereof.

10. The wipe of claim 1, wherein the cleaning composition is present as a micro-emulsion.

11. The wipe of claim 1, wherein the cleaning composition has a Natural Index of at least 99%.

12. The wipe of claim 1, wherein the water content of the cleaning composition is 10-40 wt %.

* * * * *